US008399063B2

(12) United States Patent
Chen et al.

(10) Patent No.: US 8,399,063 B2
(45) Date of Patent: Mar. 19, 2013

(54) ANTICURL BACKING LAYER DISPERSION

(75) Inventors: Cindy C. Chen, Rochester, NY (US); Bryan G. Ng, Ithaca, NY (US); Lanhui Zhang, Webster, NY (US); Man Kit Yip, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 897 days.

(21) Appl. No.: 11/350,789

(22) Filed: Feb. 10, 2006

(65) Prior Publication Data

US 2007/0190295 A1 Aug. 16, 2007

(51) Int. Cl.
*B05D 3/02* (2006.01)

(52) U.S. Cl. ..... 427/385.5; 427/393.5; 427/427.6; 428/422; 428/483; 430/56; 430/57.1; 524/502; 524/504; 524/520; 524/523; 524/546

(58) Field of Classification Search ..... 524/502, 524/504, 546
See application file for complete search history.

(56) References Cited

U.S. PATENT DOCUMENTS

| | | | | |
|---|---|---|---|---|
| 4,654,284 | A * | 3/1987 | Yu et al. | 430/58.65 |
| 5,021,309 | A | 6/1991 | Yu | |
| 5,725,983 | A | 3/1998 | Yu | |
| 5,911,934 | A * | 6/1999 | Yu et al. | 264/237 |
| 6,258,499 | B1 * | 7/2001 | Itami | 430/66 |
| 6,337,166 | B1 | 1/2002 | Chambers et al. | |
| 6,372,396 | B1 | 4/2002 | Yu et al. | |
| 6,656,650 | B1 | 12/2003 | Lin et al. | |
| 6,756,169 | B2 | 6/2004 | Lin et al. | |
| 6,822,024 | B1 * | 11/2004 | Spirkowyc et al. | 524/109 |
| 6,933,089 | B2 | 8/2005 | Horgan et al. | |
| 2003/0087171 | A1 * | 5/2003 | Tokutake et al. | 430/58.2 |
| 2005/0019682 | A1 * | 1/2005 | Inagaki et al. | 430/58.05 |
| 2008/0085459 | A1 * | 4/2008 | Kami et al. | 430/66 |

* cited by examiner

*Primary Examiner* — Nicole M Buie-Hatcher
(74) *Attorney, Agent, or Firm* — MH2 Technology Law Group LLP

(57) ABSTRACT

An anticurl backing layer dispersion, including: a volatile carrier liquid, solid organic or inorganic particles, and a surfactant, wherein the dispersion does not include a binder. An anitcurl backing layer composition including the above-described dispersion, a binder solution comprising a binder and a volatile carrier liquid, and optionally a resin, is also disclosed.

18 Claims, 4 Drawing Sheets

ANTICURL BACKING LAYER DISPERSION

DESCRIPTION OF THE DISCLOSURE

1. Field of the Disclosure

The present disclosure relates to an imaging member and, more particularly, to an anticurl backing (ACBC) layer for flexible electrostatographic imaging members and to a composition for preparing such an ACBC.

2. Background of the Disclosure

Electrostatographic flexible imaging members are well known in the art. Typical electrostatographic flexible imaging members include, for example, photosensitive members (photoreceptors) commonly utilized in electrophotographic (xerographic) processes and electroreceptors such as ionographic imaging members for electrographic imaging systems. The flexible electrostatographic imaging members can be seamless or seamed belts. Typical electrophotographic imaging member belts include a charge transport layer and a charge generating layer on one side of a supporting substrate layer and an anticurl backing layer coated on the opposite side of the substrate layer. A typical electrographic imaging member belt includes a dielectric imaging layer on one side of a supporting substrate and an anticurl backing layer on the opposite side of the substrate.

Electrophotographic flexible imaging members can include a photoconductive layer comprising a single layer or composite layers.

Complex, highly sophisticated duplicating and printing systems operating at very high speeds have placed stringent requirements including narrow operating limits on photoreceptors. For electrophotographic imaging members having a belt configuration, the numerous layers found in modern photoconductive imaging members must be highly flexible, adhere well to adjacent layers, and exhibit predictable electrical characteristics within narrow operating limits to provide excellent toner images over many thousands of cycles.

One type of multilayered photoreceptor that has been employed as a belt in electrophotographic imaging systems is known as an AMAT (active matrix) type photoreceptor and generally includes a substrate, a ground plane layer, a charge blocking layer, an adhesive layer, a charge generating layer, and a charge transport layer. This photoreceptor belt can also comprise additional layers such as an anticurl backing layer to achieve the desired belt flatness. An optional overcoating layer over the charge transport layer can be used for wear and chemical protection.

Typically, anticurl backing layer (or ACBC) formulations can include polytetrafluoroethylene (PTFE) in order to increase the wear-resistance and provide uniform wear of the backing layer. The PTFE particles are milled down and mixed into a binder solution. However, an inherent problem is the lack of stabilizers to keep the dispersion homogeneous before going to the die-coater. As such, there become differences in PTFE concentrations between the beginning and end of a coated roll.

Also, non-stabilized PTFE particles tend to aggregate, resulting in large chunks and non-uniform distribution of doped PTFE within the final coating layer. All of these issues impact the quality of active matrix (AMAT) photoreceptors and result in decreased belt yields.

GF300, a comb fluorinated graft polymer marketed by TOAGOSEI CO. LTD., has been proven to be an excellent surfactant and stabilizer for PTFE particles in organic photoconductor (OPC) PTFE-containing charge transport (CT) dispersions. However, the ability to utilize GF300 to stabilize the PTFE particles in AMAT ACBC dispersions has not been demonstrated. The main reason for the inability to demonstrate stabilization of PTFE particles with GF300 is because the AMAT ACBC system is far more complex than the CT systems in OPC due to interactions between the GF300 and the ACBC system, including binder, namely Makrolon or other polycarbonate, and solvents, such as methylene chloride. What is needed is a stable homogeneous AMAT ACBC composition for use in an anticurl backing layer.

SUMMARY OF THE DISCLOSURE

In various aspects, there is disclosed an anticurl backing layer dispersion, comprising: a volatile carrier liquid, solid organic or inorganic particles, and a surfactant, wherein the dispersion does not comprise a binder.

In various aspects, there is disclosed an anticurl backing layer composition, comprising: an anticurl backing layer dispersion comprising a volatile carrier liquid, solid organic or inorganic particles, and a surfactant, wherein the dispersion does not comprise a binder; and a binder solution comprising a binder and a volatile carrier liquid.

Additional aspects of the disclosure will be set forth in part in the description which follows, and can be learned by practice of the disclosure. The aspects, objects and advantages of the disclosure will be realized and attained by means of the elements and combinations particularly pointed out in the appended claims.

It is to be understood that both the foregoing general description and the following detailed description are exemplary and explanatory only and are not restrictive of the disclosure, as claimed.

The accompanying drawings, which are incorporated in and constitute a part of this specification, illustrate aspects of the disclosure and together with the description, serve to explain the principles of the disclosure.

BRIEF DESCRIPTION OF THE DRAWINGS

A more complete understanding of the imaging device of the present disclosure purpose can be obtained by reference to the accompanying drawings wherein.

DESCRIPTION OF THE EMBODIMENTS

Figure 1:
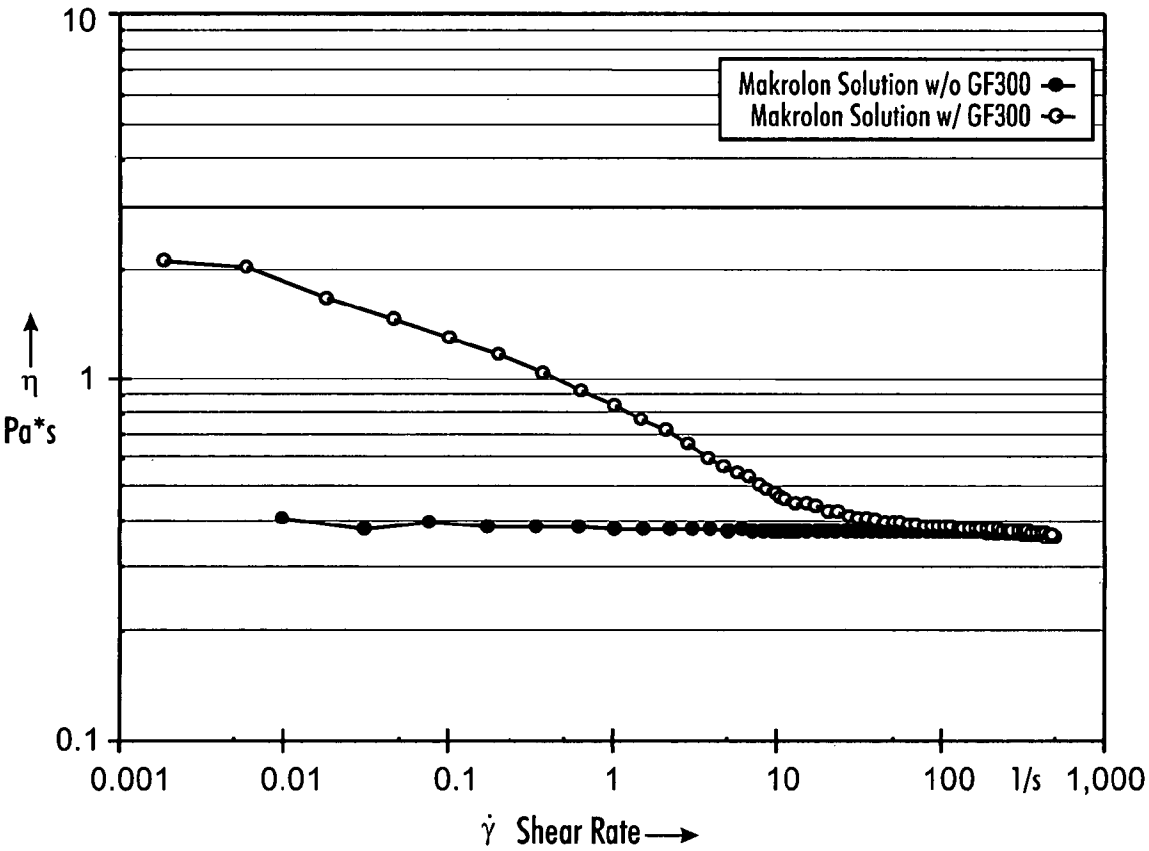
FIG. 1 is a graph showing viscosity as a function of shear rate for binder solutions with and without a surfactant.

Reference will now be made in detail to exemplary aspects of the disclosure, examples of which are illustrated by the accompanying drawings. Wherever possible, the same reference numbers will be used throughout the drawings to refer to the same or like parts.

Accordingly aspects of this disclosure teach an improved composition and process for fabricating anticurl backing layers for layered electrostatographic imaging members. Other aspects of this disclosure teach an improved composition and process for fabricating anticurl backing layers that can comprise a stable and homogenous anticurl backing layer composition.

The anticurl backing layer composition can comprise an anticurl backing layer dispersion, which can comprise volatile carrier liquid, solid organic or inorganic particles, and a surfactant, and optionally a binder solution comprising a binder and a volatile carrier liquid, and optionally a resin.

An electrostatic imaging member fabricated from the above-described composition is also contemplated. Although the discussions hereinafter will focus mainly on fabricating flexible electrophotographic imaging member belts (photoreceptor belts), they are equally applicable to fabricating electrographic imaging members (e.g., ionongraphic belts).

As disclosed above, the composition can comprise an anticurl backing layer dispersion. Any suitable volatile carrier liquid can be utilized in the anticurl backing layer dispersion. Typical volatile carrier liquids can include, for example, methylene chloride, toluene, chlorobenzene, THF, hexane, cyclohexane, heptane, and the like. For example, the anticurl backing layer dispersion can comprise from about 75 percent by weight to about 95 percent by weight of volatile carrier liquid, based on the total weight of the dispersion. The volatile carrier liquid selected for the dispersion can depend upon the components of the anticurl backing layer dispersion, e.g., the surfactant, the solid organic or inorganic particles, binder, resin, and/or substrate materials. The volatile carrier liquid can dissolve the surfactant, binder and resin, but should not dissolve the solid organic or inorganic particles and the substrates. In an aspect, the volatile carrier liquid for use in the dispersion and in the binder solution of the composition can be the same.

The volatile carrier liquid can be present in the anticurl backing layer dispersion in any desired or effective amount. In an aspect, the total solid to total liquid should be of from about 15:85 wt % to about 30:70 wt %, and for example from about 20:80 wt % to about 25:75 wt %.

The anticurl backing layer dispersion can also comprise a surfactant. Any suitable surfactant can be used so long as it has at least one of the following properties: can stabilize the solid organic or inorganic particles, and can provide a homogeneous anticurl backing layer dispersion, for example, 3M™ Novec™ Fluorosurfactant such as FC-4430 or FC-4432, Dupont Zonyl® fluoroadditives such as Zonyl® FS-300. In an aspect, the surfactant can be a specific fluorine-containing graft copolymer based on methylmethacrylate, namely GF-300, available from Toagosei Chemical Industries.

Figure 3:
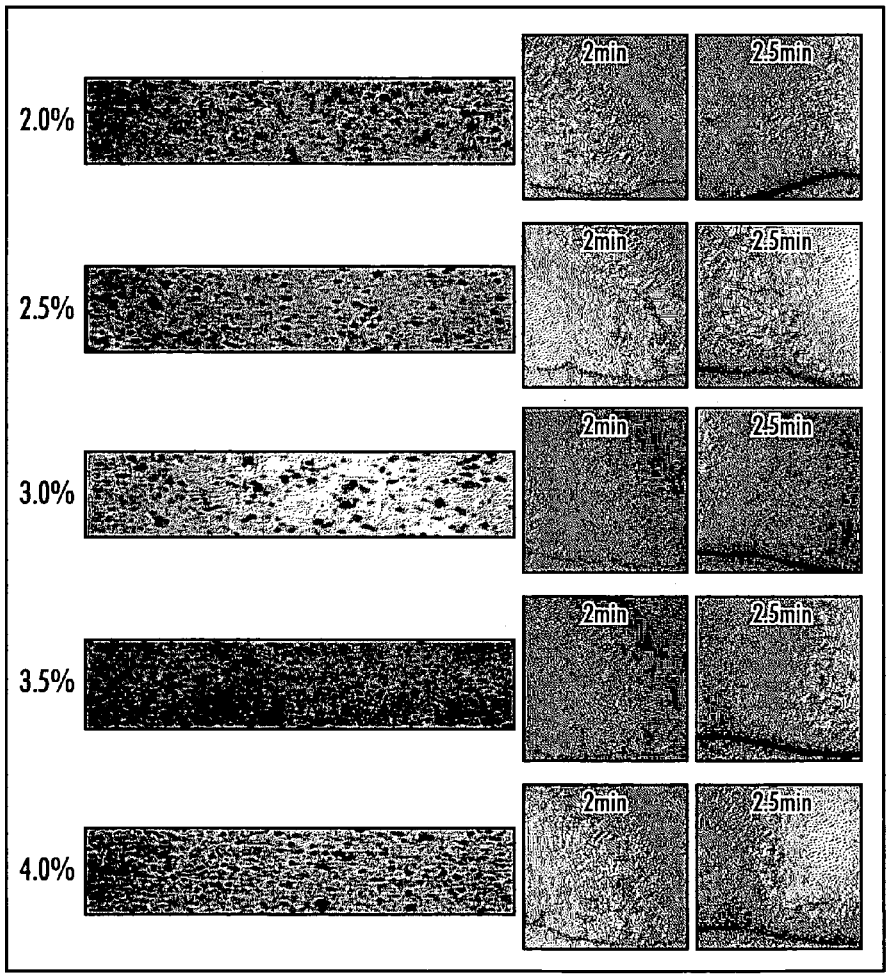
FIG. 3 shows light microscopy cross-sectional images of PTFE-doped ACBC on plain mylar with various surfactant levels and Flow Visualization of corresponding dispersions.

The surfactant can be present in the anticurl backing layer dispersion in any desired or effective amount. In an aspect, too much or too little surfactant can cause large aggregates of the solid organic or inorganic particles. The amount of the surfactant present in the dispersion can depend on the amount of the solid organic or inorganic particles. As the amount of the solid organic or inorganic particles is increased the amount of the surfactant should be proportionately increased in order to maintain the solid organic or inorganic particle dispersion quality. FIG. 3 shows the flow visulatization results of anticurl backing layer dispersion with various surfactant loadings and the cross-sectional images of coated thin layers of these dispersions. Thus, the surfactant to solid organic or inorganic particle weight ratio should be of from about 0.5 to about 8%, for example from about 1 to about 5%, and as a further example from about 1.5 to about 4%. The dispersion can contain from about 2 to about 4% by weight of organic or inorganic particles.

Any suitable solid organic or inorganic particle can be utilized in the anticurl backing layer dispersion disclosed herein. Typical synthetic organic particles can include, for example, polytetrafluoroethylene (PTFE) commercially available as POLYMIST, ALGOFLON and the like; micronized waxy polyethylene, e.g., commercially available as ACUMIST™; polyvinylidene fluoride, e.g., commercially available as KYNAR™; various metal stearates such as, for example, zinc stearate, and the like. Other organic particles are disclosed in U.S. Pat. No. 5,021,309, the disclosure of which is hereby incorporated by reference. Typical inorganic particles can include, for example, silica, surface treated or non-surface treated metal oxide, such as aluminum oxide nano or submicron particles.

The solid organic or inorganic particle size distribution can be any distribution that can provide good particle dispersion quality in the matrix of the anticurl backing layer. The particle size distribution of solid organic or inorganic particle can be of from about 0.01 micrometer to about 7 micrometers, for example from about 0.1 micrometer to about 4.5 micrometers, and as a further example from about 0.2 to about 1.5 micrometers.

Typical organic or inorganic particle dispersion concentrations in the anticurl backing layer dispersion can be of from about 0.1 weight percent to about 30 weight percent, for example from about 2 weight percent to about 15 weight percent based on the total weight of the dried anticurl backing layer.

In an aspect, the anticurl backing layer dispersion can comprise the surfactant and the solid organic or inorganic particles dispersed in the volatile carrier liquid in the absence of a binder. If a binder is present in the dispersion, then the binder can interfere with the interaction of the surfactant and the solid organic or inorganic particles thereby resulting in an unstable and possibly nonhomogeneous dispersion.

Figure 2:
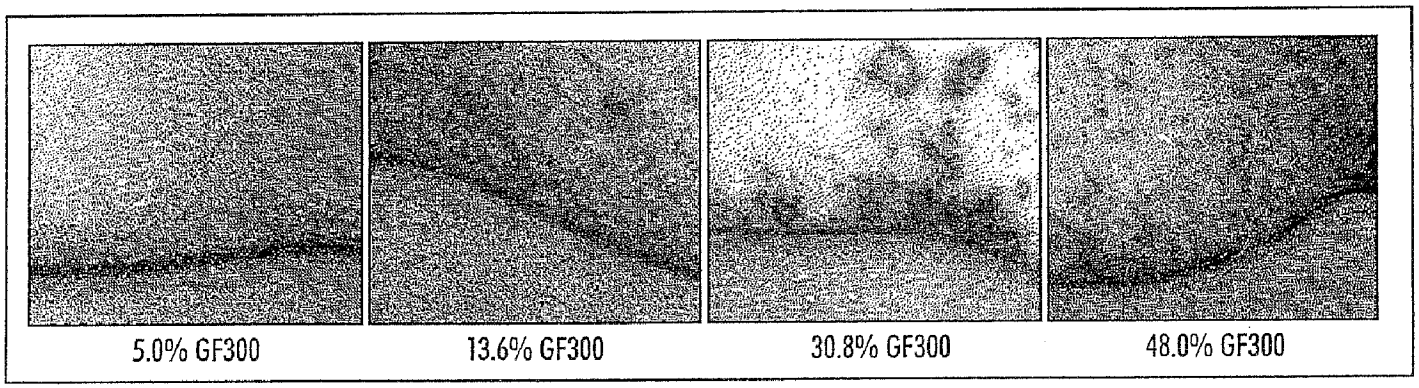
FIG. 2 shows the results of Flow Visualization of PTFE-doped ACBC dispersions with various surfactant loading (versus PTFE weight)

FIG. 1 illustrates a theological study wherein a binder solution with surfactant exhibits a higher viscosity as compared to a binder solution without surfactant. This suggests that in this solvent system the binder can interact with the surfactant and thus the binder would compete with the solid organic or inorganic particles for the surfactant when the solid organic or inorganic particles are introduced. If the binder interferes with the interaction between solid organic or inorganic particle and surfactant it could destabilize the dispersion, for example leading to severe aggregation of the solid organic or inorganic particles, as shown in FIG. 2.

The dispersion can be milled. For example, successful millings can be achieved at 35 and 125 minutes with 1 mm pitch glass beads, 125 minutes with 3 mm pitch glass beads, and 35 and 125 minutes with ⅛" stainless steel shots in a 01S attritor at full speed.

In an aspect, the anticurl backing layer dispersion can optionally comprise a resin. Any resin can be used in the dispersion or the composition so long as the resin does not interfere with the interaction between surfactant and solid organic or inorganic particle. Typical polyester resins are commercially available and include, for example, VITEL PE-100, VITEL PE-200, VITEL PE-200D, VITEL PE-2200, and VITEL PE-222, all available from Goodyear Tire and Rubber Co. The resin can be present in the anticurl backing layer dispersion or can be present in the anticurl backing layer composition. In an aspect, the resin can be present in the dispersion to increase viscosity and improve adhesion.

As discussed above, the anticurl backing layer composition can comprise the above-described anticurl backing layer dispersion, and optionally a binder solution. In an aspect, the binder is hot present in the dispersion. In another aspect, a binder solution comprising a binder and a volatile carrier liquid is present in the composition. Any suitable binder can be used so long as it is soluble in a volatile carrier liquid. Non-limiting examples of a binder include polycarbonate, polystyrene, ardel polyarylate, polyvinyl chloride, polyacrylate, polyurethane, polyester, polysulfone, and the like.

In an aspect the anticurl backing layer composition can be formed by mixing, and/or blending the anticurl backing layer dispersion with a binder solution. The mixing and/or blending can be performed under low-shear conditions to prevent settling. It is understood that "low shear" means that the shearing should be gentle enough to avoid the surfactants being deprived from the particle surface. It is believed, without being limited to any particular theory, that vigorous or high-shear mixing could cause the surfactant to become detached from the sold organic or inorganic particles, thereby allowing the surfactant to be consumed by the binder, and thereby resulting in deterioration of the dispersion.

The anticurl backing composition thereby comprises stabilized solid organic or inorganic particles thereby eliminating non-uniformity in the solid organic or inorganic particles loading at different parts of a coated belt.

Figure 4:
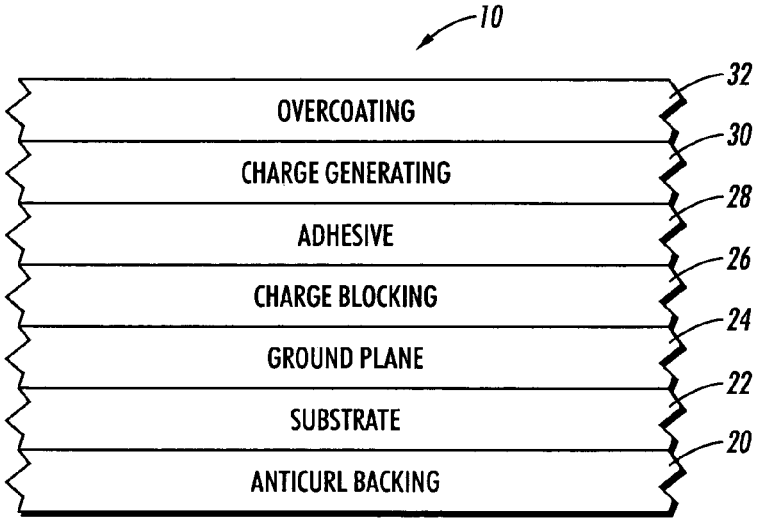
FIG. 4 illustrates a schematic partial cross-sectional view of a multiple layered, flexible sheet of electrophotographic imaging material.

Referring to FIG. 4, there is illustrated a flexible imaging member 10, for example in the form of a sheet. The flexible imaging member 10 can be utilized within an electrophotographic imaging member device and can be a member having a film substrate layer combined with one or more additional coating layers.

The flexible imaging member 10 can comprise multiple layers.

The layers of the flexible imaging member 10 can comprise numerous suitable materials having suitable mechanical properties. The belt or flexible imaging member 10 shown in FIG. 4 can comprise: an anticurl backing layer 20, a support or substrate 22, a conductive ground plane layer 24, a charge blocking layer 26, an adhesive layer 28, a charge generating layer 30, an overcoat layer 32. It should be understood that the thickness of the layers are conventional and that a wide range of thicknesses can be used for each of the layers.

The anticurl backing layer 20 can comprise a composition disclosed herein.

During machine operation, the seamed flexible imaging member belt 10 can cycle or bend over rollers, particularly small diameter rollers, of a belt support module within an electrophotographic imaging apparatus. These imaging member belts can then be utilized for imaging in electrophotographic imaging systems.

Any suitable coating technique can be utilized to apply the anticurl backing layer composition to the substrate surface 22. Typical coating techniques include, for example, extrusion coating, spraying, dip coating, roll coating, wire wound rod coating, gravure coating, Bird applicator coating, and the like.

Any suitable technique can be utilized to dry the deposited anticurl backing layer composition. Typical drying techniques include, for example, oven drying, forced air drying, focused infrared drying, RF drying, laser drying, microwave radiation, and the like.

In an aspect, the anticurl backing layer, after drying can contain less than about 1.5 percent by weight carrier liquid, based on the total weight of the dried layer.

The dried anticurl backing layer 20 can have a thickness sufficient to counteract the tendency of the flexible photoreceptor to curl after the imaging layers have been applied. In other words, the dried anticurl backing layer 20 can cause an unrestrained flexible photoreceptor sheet to lie flat on a flat surface. Thus, the thickness of the dried anticurl backing layer 20 can depend on the specific materials in and thicknesses of the other layers of any given photoreceptor. For example, the thickness of a dried anticurl backing layer 20 can be from about 10 micrometers to 25 micrometers. However, other thicknesses can alternatively be used.

The flexible substrate 22 to which the anticurl backing layer can be applied can be opaque or substantially transparent and can comprise numerous suitable materials having certain mechanical properties. Accordingly, the substrate 22 can comprise a layer of an electrically non-conductive or conductive material such as an inorganic or an organic composition. As electrically non-conducting materials, there can be employed various resins known for this purpose including polyesters, polycarbonates, polyamides, polyurethanes, polysulfones, and the like which can be flexible as thin webs. The electrically insulating or conductive substrate 22 can be flexible and in the form of a web, sheet or endless flexible belt. For example, the substrate 22 can comprise a commercially available biaxially oriented polyester known as MYLAR, available from E.I. du Pont de Nemours & Co., or MELINEX available from ICI Americas, Inc., or HOSTAPHAN, available from American Hoechst Corporation.

The thickness of the substrate layer 22 can depend on numerous factors, including beam strength and economical considerations, and thus this layer for a flexible belt can be of substantial thickness, for example, about 175 micrometers, or of minimum thickness less than 50 micrometers, provided there are no adverse effects on the final electrostatographic device.

In one flexible belt aspect, the thickness of this layer 22 can range from about 65 micrometers to about 150 micrometers, and, for example, from about 75 micrometers to about 100 micrometers for optimum flexibility and minimum stretch when cycled around small diameter rollers, e.g. 19 millimeter diameter rollers.

The conductive ground plane layer 24 on the flexible substrate can vary in thickness over substantially wide ranges depending on the optical transparency and degree of flexibility desired for the electrostatographic member. Accordingly, for a flexible photoresponsive imaging device, the thickness of the conductive ground layer 24 can be from about 20 angstrom units to about 750 angstrom units, and for example from about 100 angstrom units to about 200 angstrom units for an optimum combination of electrical conductivity, flexibility and light transmission. The flexible conductive ground layer 24 can be an electrically conductive metal layer formed, for example, on the substrate by any suitable coating technique, such as a vacuum depositing technique. Typical metals can include aluminum, zirconium, niobium, tantalum, vanadium and hafnium, titanium, nickel, stainless steel, chromium, tungsten, molybdenum, and the like. Regardless of the technique employed to form the metal layer, a thin layer of metal oxide can form on the outer surface of most metals upon exposure to air. The conductive layer need not be limited to metals. Other examples of conductive layers can be combinations of materials such as conductive indium tin oxide as a transparent layer for light having a wavelength from about 4000 angstrom units to about 0.7000 angstrom units or a transparent copper iodide (CuI) or a conductive carbon black dispersed in a plastic binder as an opaque conductive layer.

The optional charge blocking layer 26 can be applied to the electrically conductive surface prior to or subsequent to application of the anticurl backing layer to the opposite side of the substrate. Generally, electron blocking layers for positively charged photoreceptors allow holes from the imaging surface of the photoreceptor to migrate toward the conductive layer. Any suitable blocking layer capable of forming an electronic barrier to holes between the adjacent photoconductive layer and the underlying conductive layer can be utilized. The blocking layer can optionally be nitrogen containing siloxanes or nitrogen containing titanium compounds.

The charge blocking layer 26 can be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layers can be, for example, applied in the form of a dilute solution, with the solvent being removed after deposition of the coating by conventional techniques such as by vacuum, heating and the like. The blocking layer can be continuous and can have a thickness of less than about 0.2 micrometer because greater thickness can lead to undesirably high residual voltage.

The optional adhesive layer 28 can be applied to the charge blocking layer. Any suitable adhesive layer well known in the art can be utilized. Typical adhesive layer materials include, for example, polyesters, duPont 49,000 (available from E.I. duPont de Nemours and Company), Vitel PE100 (available from Goodyear Tire & Rubber), polyurethanes, and the like. Satisfactory results can be achieved with adhesive layer thickness from about 0.05 micrometer (500 angstroms) to about 0.3 micrometer (3,000 angstroms).

Conventional techniques for applying an adhesive layer coating mixture to the charge blocking layer include spraying, dip coating, roll coating, wire wound rod coating, gravure coating, Bird applicator coating, and the like. Drying of the deposited coating can be effected by any suitable conventional technique such as oven drying, infrared radiation drying, air drying and the like.

Any suitable charge generating layer 30 can be applied to the adhesive blocking layer. Non-limiting examples of typical charge generating layers can include inorganic photoconductive particles such as amorphous selenium, trigonal selenium, and selenium alloys selected from the group consisting of selenium-tellurium, selenium-tellurium-arsenic, selenium arsenide and mixtures thereof, and organic photoconductive particles including various phthalocyanine pigment such as the X-form of metal free phthalocyanine, metal phthalocyanines such as vanadyl phthalocyanine and copper phthalocyanine, dibrombanthanthrone, squarylium, quinacridones available from DuPont under the tradename Monastral Red, Monastral violet and Monastral Red Y, Vat orange 1 and Vat orange 3 tradenames for dibromo anthanthrone pigments, benzimidazole perylene, substituted 2,4-diamino-triazines, polynuclear aromatic quinones available from Allied Chemical Corporation under the tradename Indofast Double Scarlet, Indofast Violet Lake B, Indofast Brilliant Scarlet and Indofast Orange, and the like dispersed in a film forming polymeric binder. Multi-photogenerating layer compositions can be utilized where a photoconductive layer enhances or reduces the properties of the photogenerating layer. Other suitable photogenerating materials known in the art can also be utilized, if desired. Charge generating binder layers can comprise particles or layers can comprise a photoconductive material such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof can be utilized because of their sensitivity to white light. Vanadyl phthalocyanine, metal free phthalocyanine and tellurium alloys can also be utilized because these materials provide the additional benefit of being sensitive to infrared light.

Any suitable polymeric film forming binder material can be employed as the matrix in the charge generating layer 30. Thus, typical organic polymeric film forming binders can include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloridevinylchloride copolymers, vinylacetate-vinylidenechloride copolymers, styrene-alkyd resins, polyvinylcarbazole, and the like. These polymers can be block, random or alternating copolymers.

The photogenerating composition or pigment can be present in the resinous binder composition in various amounts, generally, however, from about 5 percent by volume to about 90 percent by volume of the photogenerating pigment can be dispersed in about 10 percent by volume to about 95 percent by volume of the resinous binder, and for example from about 20 percent by volume to about 75 percent by volume of the photogenerating pigment is dispersed in about 25 percent by volume to about 80 percent by volume of the resinous binder composition. In one aspect, about 50 percent by volume of the photogenerating pigment can be dispersed in about 50 percent by volume of the resinous binder composition.

The charge generating layer 30 can contain photoconductive compositions and/or pigments and the resinous binder material can generally range in thickness from about 0.1 micrometer to about 5 micrometers, and for example can have a thickness of from about 0.3 micrometer to about 3 micrometers. The charge generating layer 30 thickness can be related to binder content. Higher binder content compositions can generally utilize thicker layers for photogeneration. Thickness outside these ranges can also be selected.

Any suitable and conventional technique can be utilized to mix and thereafter apply the photogenerating layer coating mixture. Typical application techniques include spraying, dip coating, roll coating, wire wound rod coating, and the like. Drying of the deposited coating can be effected by any suitable conventional technique such as oven drying, infrared radiation drying, air drying and the like.

Other layers can alternatively be included, such as for example a conventional electrically conductive ground strip along one edge of the belt that is in contact with the conductive layer, the blocking layer, and the adhesive layer or the charge generating layer in order to facilitate connection of the electrically conductive layer of the photoreceptor to ground or to an electrical bias. Ground strips are well known and can comprise conductive particles dispersed in a film forming binder.

The optional overcoat layer 32 can also be utilized to protect the charge transport layer and can improve resistance to abrasion. These overcoat layers are well known in the art and can comprise thermoplastic organic polymers or inorganic polymers that are electrically insulating or slightly semi-conductive.

For electrographic imaging members, a flexible dielectric layer overlying the conductive layer can be substituted for the active photoconductive layers. Any suitable, conventional, flexible, electrically insulating, thermoplastic dielectric polymer matrix material can be used in the dielectric layer of the electrographic imaging member.

If desired, the flexible belts can be utilized for other purposes where cycling durability is important.

The disclosure is not intended to be limited to the materials, conditions, process parameters and the like recited herein. All proportions are by weight unless otherwise indicated.

What is claimed is:

1. An anticurl backing layer composition made by combining ingredients comprising:

an anticurl backing layer dispersion comprising:

a volatile carrier liquid, solid organic or inorganic particles, and a fluorine-containing graft copolymer based on methylmethacrylate surfactant, wherein the dispersion does not comprise a polycarbonate binder, wherein the dispersion comprises from about 2% to about 4% by weight of organic or inorganic particles, and wherein the surfactant to solid organic or inorganic particle weight ratio is from about 1.5 to about 4%; and a binder solution comprising a binder and a volatile carrier liquid;

wherein the anticurl backing layer composition does not include organic photoconductor charge transport material.

2. The composition of claim 1, wherein the solid organic or inorganic particles are polytetrafluoroethylene.

3. The composition of claim 1, wherein the volatile carrier liquid in the dispersion and the binder solution is the same.

4. The composition of claim 1, wherein the volatile carrier liquid is methylene chloride.

5. The composition of claim 1, wherein the composition has been blended under low-shear blending conditions.

6. The composition of claim 1, further comprising a resin.

7. The composition of claim 6, wherein the resin is a polyester resin.

8. An imaging member comprising an anticurl backing layer comprising the composition of claim 1.

9. A method for making a homogeneous anticurl backing layer for use in a flexible photoreceptor comprising one or more imaging layers on an first surface of the substrate, the method comprising:

providing an anticurl backing layer composition;

applying the anticurl backing layer composition to a backside surface of a substrate; and drying the anticurl backing layer composition to form the anticurl backing layer, the anticurl backing layer having a thickness sufficient to counteract the tendency of the flexible photoreceptor to curl after the one or more imaging layers have been applied, wherein providing the anticurl backing layer composition comprises mixing an anticurl backing layer dispersion and binder solution under low-shear conditions, the anticurl backing layer dispersion comprising:

a volatile carrier liquid, solid organic or inorganic particles, and a fluorine-containing graft copolymer based on methylmethacrylate surfactant, wherein the anticurl backing layer dispersion does not comprise a polycarbonate binder, and wherein the backside of the substrate is opposite to the first surface of the substrate; and wherein the anticurl backing layer is not a charge transport layer wherein the surfactant to solid organic or inorganic particle weight ratio is from about 1.5 to about 4%.

10. The method of claim 9, wherein the binder solution comprises a binder and a volatile carrier liquid.

11. The method of claim 9, further comprising milling the anticurl backing layer dispersion prior to mixing with the binder solution.

12. The method of claim 9, wherein the dispersion comprises from about 2% to about 4% by weight of organic or inorganic particles.

13. The method of claim 9, wherein the substrate is a flexible belt.

14. The method of claim 13, further comprising forming one or more imaging layers on the first surface of the substrate.

15. A method for making a flexible imaging member comprising:

providing a substrate comprising a first major surface and a second major surface that is opposite the first major surface;

mixing an anticurl backing layer dispersion and a binder solution to form an anticurl backing layer composition, the binder solution comprising a binder and a volatile carrier liquid;

applying the anticurl backing layer composition over the first major surface and drying the anticurl backing layer composition to form an anticurl backing layer; and coating one or more imaging layers over the second major surface;

wherein the anticurl backing layer dispersion comprises:

a volatile carrier liquid, solid organic or inorganic particles, and a fluorine-containing graft copolymer based on methylmethacrylate surfactant, wherein the anticurl backing layer dispersion does not comprise a polycarbonate binder wherein the surfactant to solid organic or inorganic particle weight ratio is from about 1.5 to about 4%.

16. The method of claim 15, further comprising milling the anticurl backing layer dispersion prior to mixing with the binder solution.

17. The method of claim 15, wherein the dispersion comprises from about 2% to about 4% by weight of organic or inorganic particles.

18. The method of claim 15, wherein the anticurl backing layer is not a charge transport layer.

* * * * *